United States Patent [19]

Ipsen

[11] 4,398,393

[45] Aug. 16, 1983

[54] STEAM TURBINE CONTROL APPARATUS

[75] Inventor: Peter G. Ipsen, Schenectady, N.Y.

[73] Assignee: General Electric Company, Schenectady, N.Y.

[21] Appl. No.: 305,528

[22] Filed: Sep. 25, 1981

[51] Int. Cl.[3] ..... F01D 21/02

[52] U.S. Cl. ..... 60/657; 60/662; 137/495; 251/28

[58] Field of Search ..... 60/646, 657, 660, 662, 60/677; 137/488, 495; 251/63.5, 28

[56] References Cited

U.S. PATENT DOCUMENTS

| | | | |
|---|---|---|---|
| 2,540,691 | 2/1951 | Reese et al. | 60/662 X |
| 2,586,510 | 2/1952 | Bryant | 60/662 X |
| 2,586,511 | 2/1952 | Bryant | 60/662 |

*Primary Examiner*—Allen M. Ostrager
*Assistant Examiner*—Stephen F. Husar
*Attorney, Agent, or Firm*—Robert C. Kain, Jr.; John F. Ahern

[57] ABSTRACT

Control apparatus is disclosed for limiting overspeed in a steam turbine following a sudden loss in load. The apparatus includes at least one valve disposed in the steam conduit interconnecting higher and lower pressure sections of the turbine and an actuator for controlling operation of the valve between a fully open position and a pressure-relief position wherein the valve functions as a pressure relief valve. During normal operation, the valve is maintained in the fully open position. On receipt of a turbine overspeed signal, the valve is actuated to the pressure relief position and a volume of steam at a preselected pressure, necessary to open the valve, is held back within the turbine stages, crossovers, and so forth. This retained steam is thus prevented from adding energy to increase the speed of the turbine rotor. During turbine startup, the valve is operated in its pressure relief position to permit preheating of the higher pressure sections of the turbine, avoiding long and costly startup procedures.

9 Claims, 2 Drawing Figures

STEAM TURBINE CONTROL APPARATUS

BACKGROUND OF THE INVENTION

The present invention is related to the operation of steam turbine-generators and provides apparatus for dealing with turbine overspeed following a sudden loss of load and for dealing with the application of preheat to certain sections of the turbine prior to application of significant load.

In the operation of a steam driven turbine-generator, decreases in electrical load on the generator tend to cause an increase in rotational speed. With a sudden and substantially complete loss of generator load, such as occurs, for example, with a circuit breaker tripout, there is some potential for increasing the turbine speed even to destructive levels. This prospect is, of course, carefully guarded against and protective overspeed control means have been developed and incorporated into turbine control systems to rapidly close the steam valves and shut off the supply of motive fluid as an overspeed condition is detected. In an extreme condition the turbine is "tripped" automatically by the control system, a condition requiring operator intervention before steam is again admitted to the turbine.

Following an overspeed closure of the steam valves, there is a significant additional speed rise attributable to steam retained within the turbine stages, shells, inlet passages, various crossovers, extraction lines, and so forth. This steam exhausts itself through lower pressure sections of the turbine and, in the absence of a load to sustain, the energy of the steam is spent by increasing the turbine speed. While this may be regarded as a momentary or transient condition, overspeed due to these "entrained steam energies" must be kept within reasonable bounds for several important reasons.

Among these, three are particularly noteworthy. First, the speed rise must be limited to a level at which the resulting centrifugal stresses on the rotor do not significantly detract from its operating life. Second, it is desirable to maintain the speed rise below the value at which automatic tripping takes place, so that the turbine remains under control of the speed governor, ready to assume load to satisfy the requirements of the power system. Third, for those situations in which local auxiliary equipment remains electrically tied to the generator, it is important to limit the speed rise to a value that is not detrimental to such auxiliary equipment.

As an additional consideration, the art of steam turbine and generator design has progressed such that the relationship between maximum power output and the moment of inertia of the rotating component has changed in a direction which makes it even more difficult to keep the speed rise resulting from "entrained steam energies" within reasonable bounds.

Accordingly, it is an object of the present invention to provide control apparatus by which turbine overspeed is more closely controlled following a sudden loss in the load on a turbine-generator.

Significantly, the apparatus of the present invention also provides a solution to another problem of long standing in the operation of a turbine-generator. That is, in the higher pressure sections of a steam turbine the shell and rotor components are constructed of alloys that have excellent strength when operating at high temperatures but which must be operated above a minimum temperature of about 300° F. to render them properly ductile. In the past, to preheat the high temperature portions of a turbine enough to attain this threshold temperature, a complex and lengthy procedure has been required before the turbine could be put to productive use.

In this regard, it is yet another object of the present invention to provide means by which the turbine preheating period can be reduced and replaced by a less complex, shorter preheating process.

SUMMARY OF THE INVENTION

These and other objects are attained by providing, in combination with a steam turbine, at least one back-pressure control valve (termed at times herein a "pressure-relief intercept valve") disposed in the steam conduit, or crossover, which fluidly interconnects higher and lower pressure sections of the turbine. Preferably, the pressure-relief intercept valve is operable by an actuator which, during normal turbine operation, maintains the valve fully open in response to a signal from the turbine control systems. On the other hand, following closure of the control valves due to overspeed (on command from a turbine overspeed signal), or during turbine start-up (under command from operating personnel), the valve is in a position in which it is normally closed but remains responsive to be forced open at a preselected differential pressure level between the valve input and output ports. That is, in the second position (or mode) the valve operates as a pressure-relief valve.

For example, for a reheat steam turbine a pressure-relief intercept valve is advantageously used in the crossover conduit between the reheat turbine section and the lower pressure turbine section (or sections, in case there are multiple low pressure sections). On loss of load the valve actuator is given a signal to close coincidentally with the closure of the conventional steam admission control and intercept valves. However, since the pressure-relief intercept valve only stays closed against pressures above a preselected minimum pressure (e.g., 70 psia), only a portion of the stored energy in the steam remaining in the reheat section can escape to the low pressure section to contribute to a speed rise. A volume of steam at the preselected pressure is held back and is prevented from adding energy to the turbine rotor.

The invention also has application to non-reheat turbines in which the high-pressure and low-pressure sections are connected by a crossover. Furthermore, a plurality of valves may also be used in which each valve is located, relative to higher and lower pressure sections of a turbine, to retain a volume of steam at some preselected pressure level.

During turbine startup, the pressure-relief intercept valve can be operated in its pressure-relief position. This allows the higher pressure sections of the turbine to be preheated by pressurizing those sections with steam up to the pressure-relief point. For example, pressurizing with saturated steam at about 70 psia allows preheating to about 300° F. before even starting the turbine. This puts the shell and rotor metal safely into the ductile temperature range and eliminates a long and costly start-up procedure.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

Figure 1:
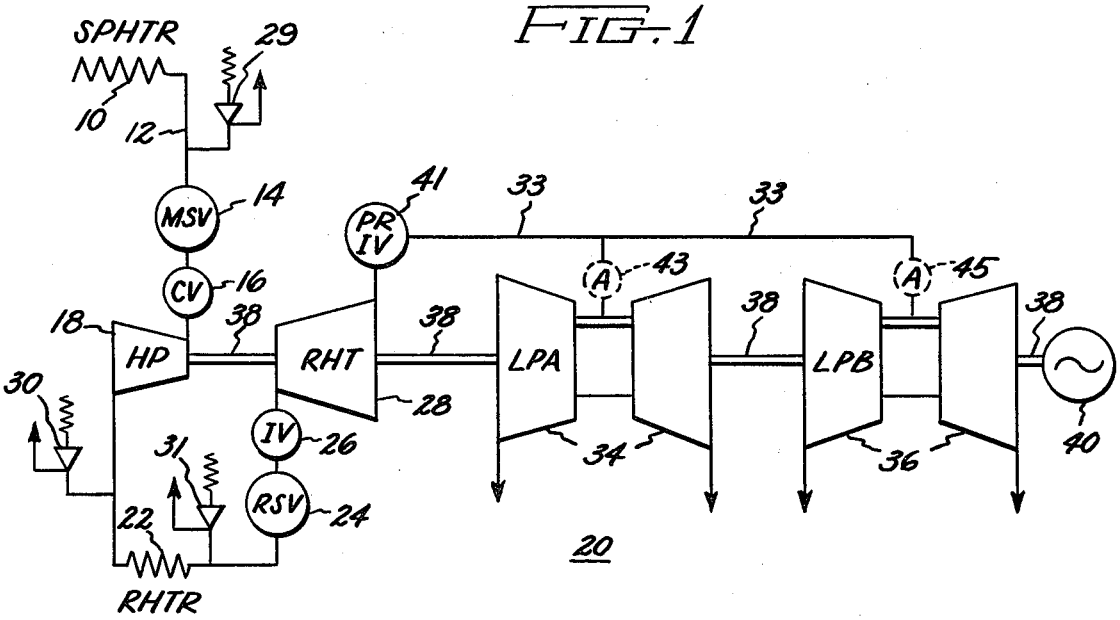
FIG. 1 shows, in schematic form, a tandem compound reheat turbine, having a pressure-relief intercept valve, at preferred and alternative locations, according to the invention.

FIG. 1 illustrates a typical reheat steam turbine, generally designated 20, appropriate for use with the invention and in which high-pressure, high-temperature steam from boiler superheater 10 is supplied through steam conduit 12, main stop valve 14, and admission control valve 16 to the high-pressure section 18 of the turbine 20 to serve as motive fluid. Steam exhausted from the high-pressure section 18 passes through a reheater 22, reheat stop valve 24, intercept valve 26, and enters reheat turbine section 28, providing additional energy to drive the turbine 20. Conventional pressure-relief valves 29, 30, and 31 are provided at various points along the steam path generally as shown. A steam crossover conduit 33 fluidly interconnects the exhaust end of reheat section 28 with parallel-connected low-pressure sections 34 and 36. Although all of the turbine sections 18, 28, 34, and 36 are shown to be tandemly coupled through shaft 38 to generator 40, other coupling arrangements may be used. Further, it will be apparent that additional low pressure sections may be included in some turbine installations. At the exit of reheat section 28 there is provided a pressure-relief intercept valve 41 according to the invention.

Valve 41 is more fully described hereinbelow, but in general it is provided with means so that it will only stay closed whenever the differential pressure between its input and output ports is less than some preselected value. Thus, valve 41 is a form of pressure-relief valve which is, however, held fully open by mechanical/hydraulic actuator means during normal turbine operation in the absence of an overspeed signal.

With a loss of load sufficient to generate an appropriate overspeed signal, valve 41 is given a signal causing it to close. In this position, because of the pressure-relief feature, only a portion of the stored energy in reheat section 28 is able to be transferred to the low-pressure sections 34 and 36 and contribute to the turbine speed rise. A volume of steam at the preselected pressure (e.g., 70 psia) is held back and is thus prevented from adding energy to the rotor system and causing further speed rise.

Signals for closing valve 41 in case of an overspeed and for holding the valve 41 open during normal operation are available from the conventional turbine control system. For example, overspeed control means generating appropriate overspeed signals are disclosed in U.S. Pat. No. 3,601,617 and in U.S. Pat. No. 3,614,457, the disclosures of which are incorporated herein by reference. Overspeed control responses occur in stages depending on the magnitude of the overspeed. The first, or "normal" overspeed response takes place at a relatively small rise above the normal speed and closes the control and intercept valves, such as valve 16 and valve 26, which may then be rather quickly reopened as the speed returns to normal. In addition, one or more "emergency" overspeed responses takes place should the shaft speed increase to higher levels of overspeed. These responses are designed to close the stop valves 14 and 24 in addition to the control and intercept valves. In an extreme situation the valves are controlled to be reopened only by positive intervention of operating personnel.

Preferably the closure of valve 41 occurs coincidentally with the signal which causes closure of the control and intercept valves 16 and 26 respectively, i.e., in phase with the normal overspeed response. In this regard, it will be noted that control valve 16 and intercept valve 26 schematically represents a plurality of valves, all of which close in the event of an overspeed condition. This and other simplifications are made in FIG. 1 to more clearly focus on the present invention.

While a pressure-relief intercept valve 41 is preferably provided at the exhaust end of reheat section 28, it is also effective in the control of overspeed to provide such valves at the inlet of each low-pressure section of a turbine. Thus, in FIG. 1 the dashed lines indicate alternative pressure-relief intercept valves 43 and 45 provided, respectively, at the inlets to low-pressure sections 34 and 36. Valves 43 and 45 provide the additional benefit of retaining the volume of steam in the crossover 33 at some pressure above condenser pressure, say 70 psi, so that it does not contribute to the overspeed. In the event of an overspeed signal, valves 43 and 45 close substantially simultaneously.

Although the foregoing discussion has been in terms of a reheat-type turbine, it will be apparent to those skilled in the art that this is not an inherent limitation of the invention. For example, the invention may also be advantageously incorporated into a turbine system in which the high-pressure section is discharged directly to a low-pressure section without the steam first passing through a reheater.

An additional and important advantage of the invention is that it facilitates preheating of the rotor and shell of the reheat section of a reheat turbine, or the high-pressure section of a non-reheat turbine, to a level sufficient to put these parts, which are made of an alloy suitable for high temperature service, into a ductile temperature zone. It is desirable that this temperature be reached before the turbine is brought up to speed. Preheating is accomplished simply by allowing high-pressure section 18 and reheat section 28 to become pressurized with steam up to the point of which valve 41 begins to open. For example, if the valve 41 is preset to open at 70 psia, steam pressure is maintained on turbine sections 18 and 28 at this pressure which corresponds, for saturated steam, to approximately 300° F. This is a suitable temperature to make the alloy of the rotor and shell ductile. This simple procedure significantly reduces the time and complexity of previous procedures to preheat these turbine sections.

Figure 2:
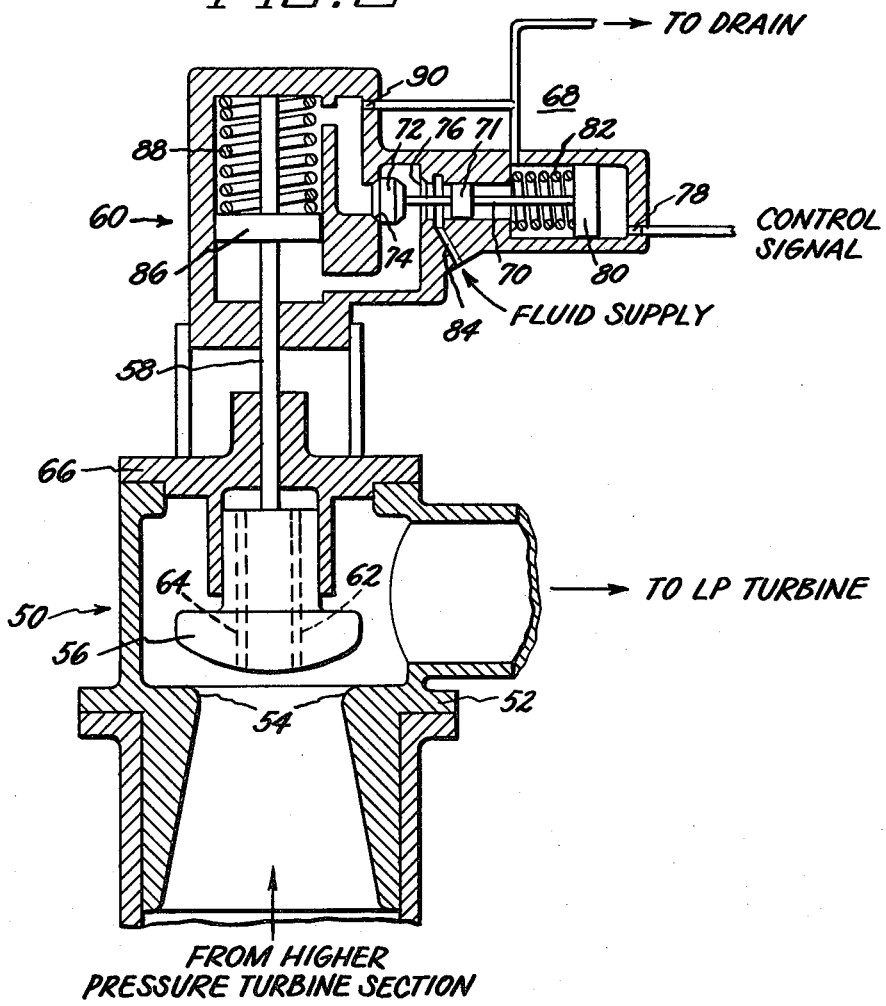
FIG. 2 illustrates, in a vertical cross-sectional view, one form of a valve suitable for use according to the invention.

FIG. 2 illustrates one valve and actuator combination suitable for use as a pressure-relief intercept valve according to the invention. It will be apparent, however, that various other valve configurations may be utilized. For example, with some turbines it will be preferable to use a butterfly-type valve, spring-loaded to open under a preselected pressure drop.

In FIG. 2, steam from a higher pressure turbine section (high-pressure or reheat section) enters the valve body 52, passes through valve seat 54 and on to a lower pressure section of the turbine. The valve, designated generally as 50, is mechanically and hydraulically actuated and is shown in its actuated open position. Valve disk 56, connected through stem 58 to an actuator designated generally as 60, includes pressure-balancing holes 62 and 64 to balance (in a well-known manner) the steam pressure forces on the disk 56. This feature permits the use of smaller and weaker springs to actuate the valve disk 56. The valve stem 58 and disk 56 are retained by guide member 66.

Actuator 60 includes a smaller pilot valve 68 having a hydraulically actuated valve stem 70, including guide seal 71, for moving a smaller disk 72 between valve seats 74 and 76. As shown, a hydraulic pressure signal applied through control signal port 78 causes piston 80, acting against spring 82, to force disk 72 firmly against the valve seat 74. Hydraulic fluid from supply port 84 is thus allowed to pass to the underside of piston 86 which, acting against spring 88, keeps the valve disk 56 in the open position as shown.

A turbine overspeed signal occurs in the form of a quick release of the pressure from control signal port 78. In that case, spring 82, acting on piston 80, moves valve disk 72 away from seat 74 and forces it into sealing engagement with seat 76 sealing off the fluid supply port 84. Hydraulic fluid from the underside of piston 86 is released through valve seat 74 to the chamber for spring 88 and to drain port 90. Spring 88 acts to urge valve disk 56 downward into sealing contact with valve seat 54. However, spring 88 is sized in consideration of the unbalanced steam forces on disk 56 so that disk 56 can seal against valve seat 54 only when the steam pressure is below a preselected level. Steam pressures above this level are sufficient to force the valve disk 56 off of the seat 54 until enough steam has been exhausted to release the pressure to the valve closing point.

Thus, while there has been shown and described what is considered a preferred embodiment of the invention, it is understood that various other modifications may be made therein. For example, although a spring-loaded, pressure-relief intercept valve of a particular kind has been disclosed herein, it will be apparent to those of ordinary skill in the art that other kinds of valves utilizing various closing bias means may be incorporated into the invention. It is intended to claim all such modifications which fall within the true spirit and scope of the present invention.

The invention claimed is:

1. In combination with a steam turbine in which steam exhausted from a higher pressure turbine section is passed through an interconnecting steam conduit to a lower pressure section, a system for controlling overspeed in the turbine following a sudden loss in load, comprising:

at least one valve disposed in the steam conduit to receive steam from said higher pressure section at an inlet port of said valve and to discharge steam to said lower pressure section at an outlet port of said valve; and an actuator for controlling operation of said valve between a fully open position and a pressure-relief position wherein said valve is responsive to be open only when the steam pressure at said inlet port is greater than the steam pressure at said outlet port by a preselected amount, said actuator being responsive to a turbine overspeed signal generated in response to said sudden loss in load to cause said valve to be operated in said pressure-relief position.

2. The combination of claim 1 wherein said at least one valve is disposed in said conduit at the outlet of said higher pressure turbine section.

3. The combination of claim 1 wherein said at least one valve is disposed in said conduit at the inlet to said lower pressure turbine section.

4. The combination of claims 1, 2, or 3, wherein said actuator is hydraulically actuated and said valve is biased toward said pressure-relief position by a spring.

5. The combination of claim 4 wherein said actuator includes a smaller pilot valve directing hydraulic fluid within said actuator for controlling the operation of said valve.

6. In combination with a steam turbine in which steam exhausted from a higher pressure section is passed through an interconnecting steam conduit to a lower pressure section, apparatus for controlling overspeed in the turbine following a sudden loss in load while maintaining a preselected amount of steam pressure within said higher pressure section, such apparatus comprising:

a valve having an inlet port and an outlet port, said valve being disposed in the steam conduit to receive steam from said higher pressure section at said inlet port and to discharge steam to said lower pressure section at said outlet port; and an actuator for controlling operation of said valve between a fully open position and a pressure-relief position wherein said valve is responsive to be open only when the steam pressure at said inlet port is greater than the steam pressure at said outlet port by said preselected amount of pressure, said actuator being responsive to a first signal to cause said valve to be operated in said open position and responsive to a second signal to cause said valve to be operated in said pressure-relief position.

7. The apparatus of claim 6 wherein said valve is disposed in said conduit at an end thereof adjacent said higher pressure section.

8. The apparatus of claim 6 wherein said valve is disposed in said conduit at an end thereof adjacent said lower pressure section.

9. The apparatus of claims 6, 7, or 8, wherein said actuator is hydraulically actuated and said valve is biased towards said pressure-relief position by a spring.

* * * * *